US008316677B2

(12) United States Patent
Anthenat et al.

(10) Patent No.: US 8,316,677 B2
(45) Date of Patent: Nov. 27, 2012

(54) METHOD AND APPARATUS FOR HIGH VELOCITY ELECTROMAGNETIC SEALING OF CONTAINERS

(76) Inventors: Alan S. Anthenat, Edwardsville, IL (US); Bruce A. Anthenat, Tijeras, NM (US)

( * ) Notice: Subject to any disclaimer, the term of this patent is extended or adjusted under 35 U.S.C. 154(b) by 969 days.

(21) Appl. No.: 12/307,864

(22) PCT Filed: Jul. 12, 2007

(86) PCT No.: PCT/US2007/073385

§ 371 (c)(1),
(2), (4) Date: Jan. 7, 2009

(87) PCT Pub. No.: WO2008/008906

PCT Pub. Date: Jan. 17, 2008

(65) Prior Publication Data

US 2010/0064751 A1 Mar. 18, 2010

Related U.S. Application Data

(60) Provisional application No. 60/819,900, filed on Jul. 12, 2006.

(51) Int. Cl.
*B21D 26/02* (2011.01)
*B23P 19/02* (2006.01)

(52) U.S. Cl. ..... 72/56; 72/54; 29/426.4; 29/419.2; 53/488

(58) Field of Classification Search ..... 72/54, 56, 72/57, 61, 62, 430; 29/426.4; 53/488
See application file for complete search history.

(56) References Cited

U.S. PATENT DOCUMENTS

| | | | | | |
|---|---|---|---|---|---|
| 2,850,859 | A | | 9/1958 | Taylor et al. | |
| 3,426,564 | A | | 2/1969 | Jansen et al. | |
| 3,526,076 | A | * | 9/1970 | Auerswald et al. | 72/56 |
| 3,581,456 | A | * | 6/1971 | Gere | 72/56 |
| 3,706,176 | A | * | 12/1972 | Leatherman | 53/488 |
| 3,842,574 | A | * | 10/1974 | Dickey | 53/488 |
| 3,912,102 | A | | 10/1975 | Michel | |
| 4,219,986 | A | | 9/1980 | Osterhaus | |
| 5,335,801 | A | | 8/1994 | Lee | |
| 5,444,963 | A | * | 8/1995 | Steingroever et al. | 53/488 |
| 5,452,506 | A | * | 9/1995 | Biedermann et al. | 29/426.4 |
| 5,794,804 | A | | 8/1998 | Sloan et al. | |
| 5,925,029 | A | | 7/1999 | Jansen et al. | |
| 6,196,045 | B1 | | 3/2001 | Thomas | |

OTHER PUBLICATIONS

International Search Report and Written Opinion dated Jan. 28, 2008 for PCT/US07/73385 (8 pages).

* cited by examiner

*Primary Examiner* — David B Jones
(74) *Attorney, Agent, or Firm* — Brian B. Diekhoff; Polsinelli Shughart PC

(57) ABSTRACT

Methods and apparatus for high velocity electromagnetic metal forming are described for sealing containers. The methods include applying an electromagnetic field to the container to seal a metal containing cap to the container. One or more containers may be simultaneously sealed. The apparatus includes an actuator that emits the electromagnetic field to seal the caps to the containers. The containers may contain a medicine.

19 Claims, 14 Drawing Sheets

METHOD AND APPARATUS FOR HIGH VELOCITY ELECTROMAGNETIC SEALING OF CONTAINERS

FIELD OF INVENTION

The present invention relates to methods and apparatus for high velocity electromagnetic metal sealing of metal caps onto vials containing medicine.

BACKGROUND

Prior art capping technology uses mechanical forming to crimp a metal seal onto a vial or other container for medicines. Normally, blades are used that reshape an edge of the seal under a top lip of the vial to form the seal. Such technology has several limitations. First, the prior art capping technology does not satisfy particle contamination parameters placed on the industry. As the metal seal is crimped in the prior art methods, particles of the metal seal may be released, and these particles may end up in the vial, resulting in the contamination of a medicine in the vial. As such, classified aseptic (and non-aseptic) conditions may be lost due to particle contamination generated by the prior art metal crimping and forming methods.

Secondly, the seal formed by the prior art method may sometimes be rotated upon the vial, which may be perceived by some in the industry as an inferior seal.

Further, either the container or the head on the machine must rotate during the sealing process, this often causes scratching, marring, or even breakage of the container. The extensive manual adjustments and the use of a metal blade against glass with poor tolerances also causes scratching, marring, or even breakage of the container. Some breakage of the container may not be apparent to post-process inspections. Glass that may have chipped inside the vial can potentially be extremely harmful to the patient. Another form of breakage, such as a hairline crack, may cause harm to the patient as well. For example, if a hairline crack allows outside atmosphere to interact with medicines that are oxygen sensitive, the medicine may be inactivated or even harmful when given to the patient.

Fourth, in addition to possibly harmful effects of damage to the container, current technology creates cosmetic side effects that internal and/or external quality departments, clinicians, and physicians often reject. For example, a vial that may have perfectly good product inside, but a cap that has been partially sliced by a blade, may often result in rejection by the physician or treating medical personnel, thereby losing that dosage and increasing the cost of the medicine.

SUMMARY OF INVENTION

In one embodiment, a method for sealing a plurality of non-metallic containers using high velocity electromagnetic metal forming is described. The method comprises: engaging one or more non-metallic containers with a cap, each cap having a metal portion, applying electromagnetic forces to the metal portion of each cap engaged to the one or more non-metallic containers, and sealing the cap engaged to the one or more non-metallic containers by application of the electromagnetic forces.

In another embodiment, a method for sealing one or more vials using high velocity electromagnetic metal forming is described. The method comprises: engaging one or more vials with a cap, each cap having a metal portion; directing the one or more vials to an actuator; applying electromagnetic forces from the actuator to the metal portion of each cap; and sealing the cap engaged to the one or more vials by application of the electromagnetic forces.

In another embodiment, a method for sealing caps on non-metallic containers using high velocity electromagnetic metal forming is described. The method comprises: feeding at least one non-metallic container to a capping assembly, engaging a cap onto each of the at least one non-metallic container in the capping assembly, feeding the at least one non-metallic container to an actuator assembly, and applying electromagnetic forces from the actuator assembly to seal the cap onto each of at least one non-metallic container.

In another embodiment, a capping device for sealing caps on non-metallic containers using high velocity electromagnetic forming is described. The capping device comprises: an infeed assembly comprising a receptacle to receive at least one non-metallic container; the infeed assembly further comprising a first passage, a capping assembly connected to the first passage of the infeed assembly, the capping assembly comprising a second passage and connecting to a supply of caps for engaging the cap to one of the at least one non-metallic container; an actuator assembly connected to the second passage of the capping assembly, the actuator assembly being capable of emitting electromagnetic forces for sealing the cap to the at least one non-metallic container; and an outfeed assembly that dispenses the at least one non-metallic container from the actuator assembly.

In another embodiment, an apparatus for sealing caps on vials using high velocity electromagnetic metal forming is described. The apparatus comprises: a capping assembly directing one or more vials to receive caps; a loading assembly positioning the one or more vials proximate to an actuator assembly; the actuator assembly comprising an actuator that emits electromagnetic forces to seal the caps to the vials.

DESCRIPTION OF PREFERRED EMBODIMENTS

Figure 1:
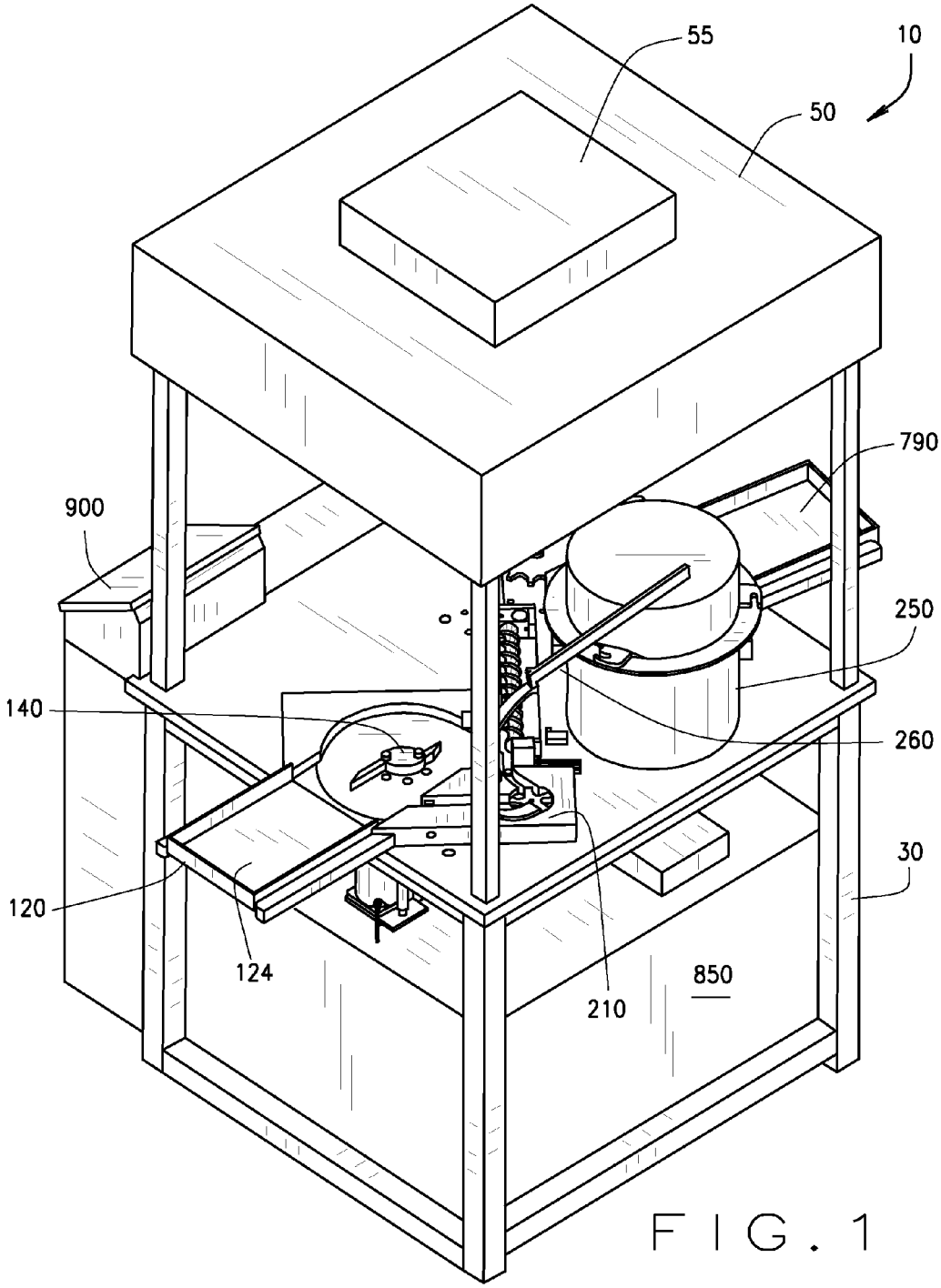
FIG. 1 shows a perspective use of the capping device.

Methods and apparatus for high velocity electromagnetic metal forming are described for sealing containers. The methods and apparatus are used in the capping of and sealing one or more containers of pharmaceutical medicines. The containers will be in the form of a vial or syringe. The container may be made from a plastic or glass material. The containers are of a non-metallic material. A plurality of vials may also be simultaneously sealed.

The vials are generally filled with an amount of medicine; but the vials may occasionally be sealed empty. Generally, the medicine does not completely fill the vial. A stopper is then inserted into the vial. The stopper may be made from siliconized rubber or other similar materials. The vial and stopper are then capped and sealed using the methods and apparatus described herein. The electromagnetic forming processes provides a firm seal to seal the top of the vial and stopper to ensure that the stopper remains firmly seated in the opening of the vial.

The method includes capping or engaging one or more vials with the caps. The caps may be made entirely of metal or some combination of metal and plastic. After placing the cap on the vial, the one or more vials are directed to an actuator. The actuator emits electromagnetic forces to seal the cap on each vial of the one or more of vials.

The methods and apparatus may be used in an aseptic environment without contaminating the aseptic environment. The methods and apparatus may also be used in a non-aseptic environment equally well. The apparatus does not physically use an implement, such as a blade, to crimp the metal cap to the vial. Instead, electromagnetic forces are applied by an actuator, which forms the seal on the vial.

In certain embodiments, the apparatus may be contained under a plexiglass cover or housing to prevent external contaminants from entering the device or the vials. Of course, the apparatus and methods may also be used for sealing applications in non-aseptic environments.

The methods and apparatus provide for the high speed sealing of the vials. Embodiments may seal up to approximately 100 vials per minute or more. Of course, one of ordinary skill in the art will recognize that a smaller number of vials may be sealed if desired by the operator. Other embodiments may seal upwards of 150 vials per minute, 200 vials per minute, 250 vials per minute, 300 vials per minute, 350 vials per minute, 400 vials per minute, 450 vials per minute, etc.

The actuator applies the electromagnetic forces for sealing the metal cap to the vial. The actuator may need to only apply the electromagnetic sealing forces for a fraction of a second or less in order to completely seal the metal cap to the vial. Typically, the vials are sealed in the less than 20 milliseconds. The actuator may only need to emit approximately 0.15 kilojoules for the sealing of a single vial. For a sealing application where approximately 10 vials are simultaneously sealed, then the actuator may only need to emit approximately 4.5 kilojoules or more.

The actuator includes actuator openings that each receive a capped vial for sealing. The actuator may include many different geometries and number of actuator openings. The capped vials need to be placed proximate the actuator openings for the magnetic sealing. In some embodiments, the capped vials are placed into the actuator opening. In other embodiments, the actuator may be lowered over the capped vials or the actuator may be placed around the capped vials.

In operation, the actuator is loaded with capped vials until all or nearly all of the actuator openings contain a capped vial. Next, the actuator emits the electromagnetic forces to seal the capped vials. Then, the actuator is emptied of the sealed vials, and additional vials are loaded into the actuator for sealing. A programmable logic controller monitors and controls the loading off the actuator, the emission of the electromagnetic forces from the actuator to the vials, the emptying of the actuator of the sealed vials, and the reloading of the actuator with additional vials for sealing. The programmable logic controller is programmed with the quantity of vials relative to the particular actuator currently used in the device.

The vials may have a volume of 0.1 ml to approximately 500 ml, such as, for example volumes of 0.1 ml, 0.2 ml, 0.3 ml, 0.4 ml, 0.5 ml, 10 ml, 20 ml, 30 ml, 40 ml, 50 ml, 60 ml, 70 ml, 80 ml, 90 ml, 100 ml, 200 ml, 300 ml, etc. The vials may have a neck opening of approximately 5 mm in diameter to approximately 50 mm in diameter, such as, for example 5 mm, 9 mm, 10 mm, 13 mm, 20 mm, 27 mm, 32 mm, and 40 mm. The seal may be made of aluminum, copper, brass, stainless steel, or other suitable electrically conductive material.

The container may be used for storage and transfer of pharmaceutical, biotech, neutraceutical, and veterinary medicines. The container is well suited for the storage of injectable pharmaceuticals, such as saline, insulin, etc.

The method and systems may simultaneously seal a plurality of units. Certain embodiments may simultaneously seal 1, 2, 3, 4, 5, 6, 7, 8, 9, 10, 11, 12, 13, 14, 15, 16, 17, 18, 19, or 20 or more units. This provides an efficient throughput, and reduces packaging costs.

The methods and apparatus will now be described with reference to the Figures. A first embodiment exemplifying the methods and apparatus, namely a capping device 10, is generally shown in FIGS. 1 and 3-5.

Figure 2:
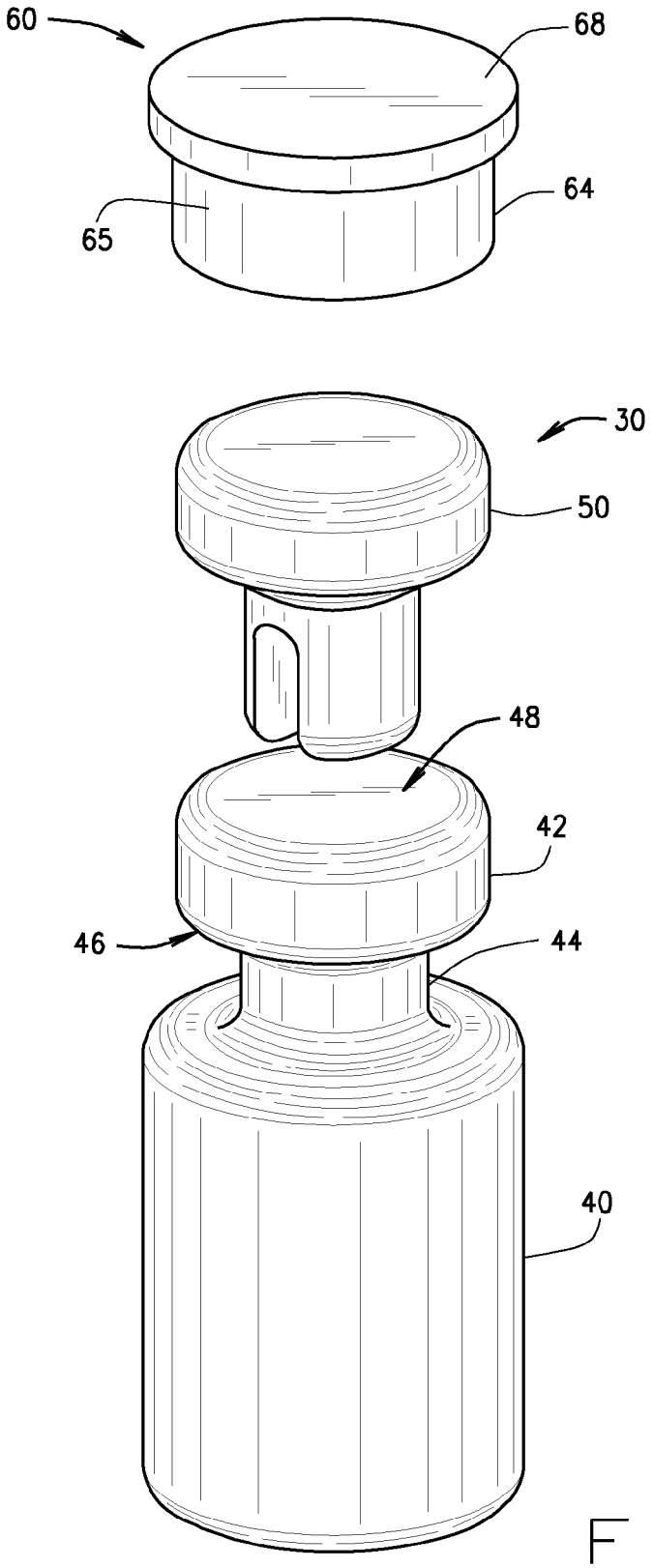
FIG. 2 shows an exploded view of the vial assembly.
Figure 3:
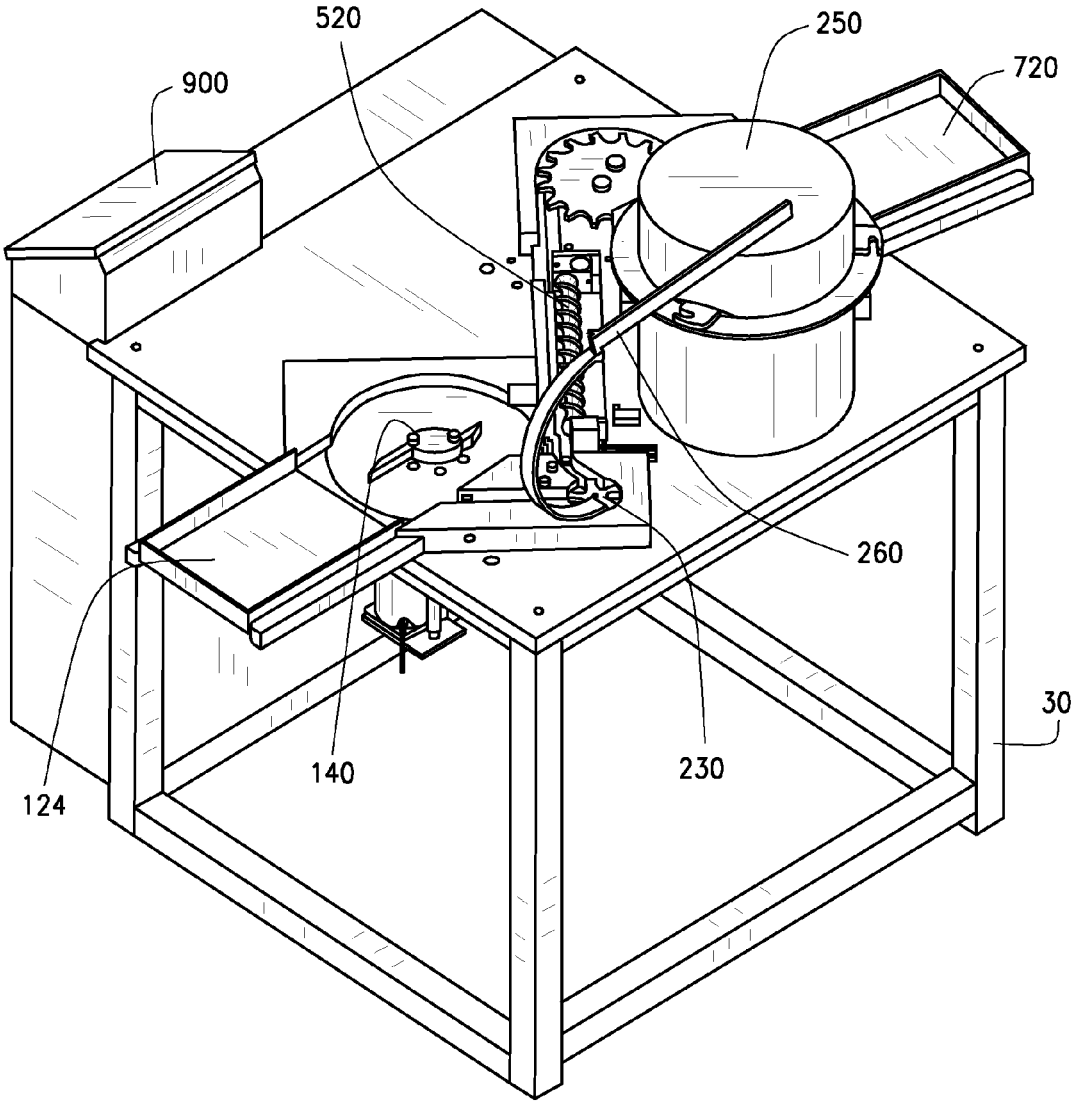
FIG. 3 shows a perspective view of the capping device with the hood removed.
Figure 4:
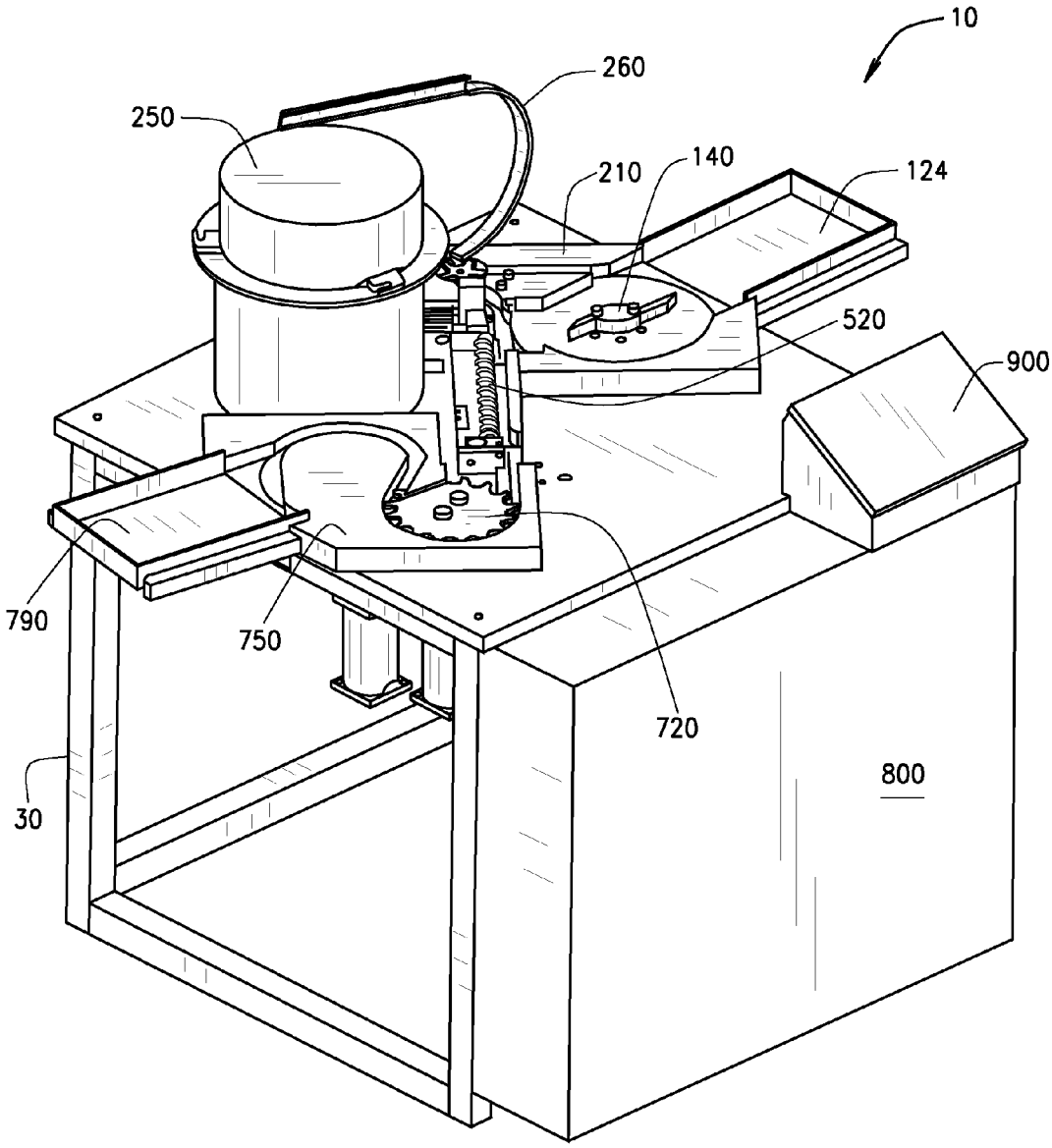
FIG. 4 shows a view of the capping device with the hood removed.
Figure 5:
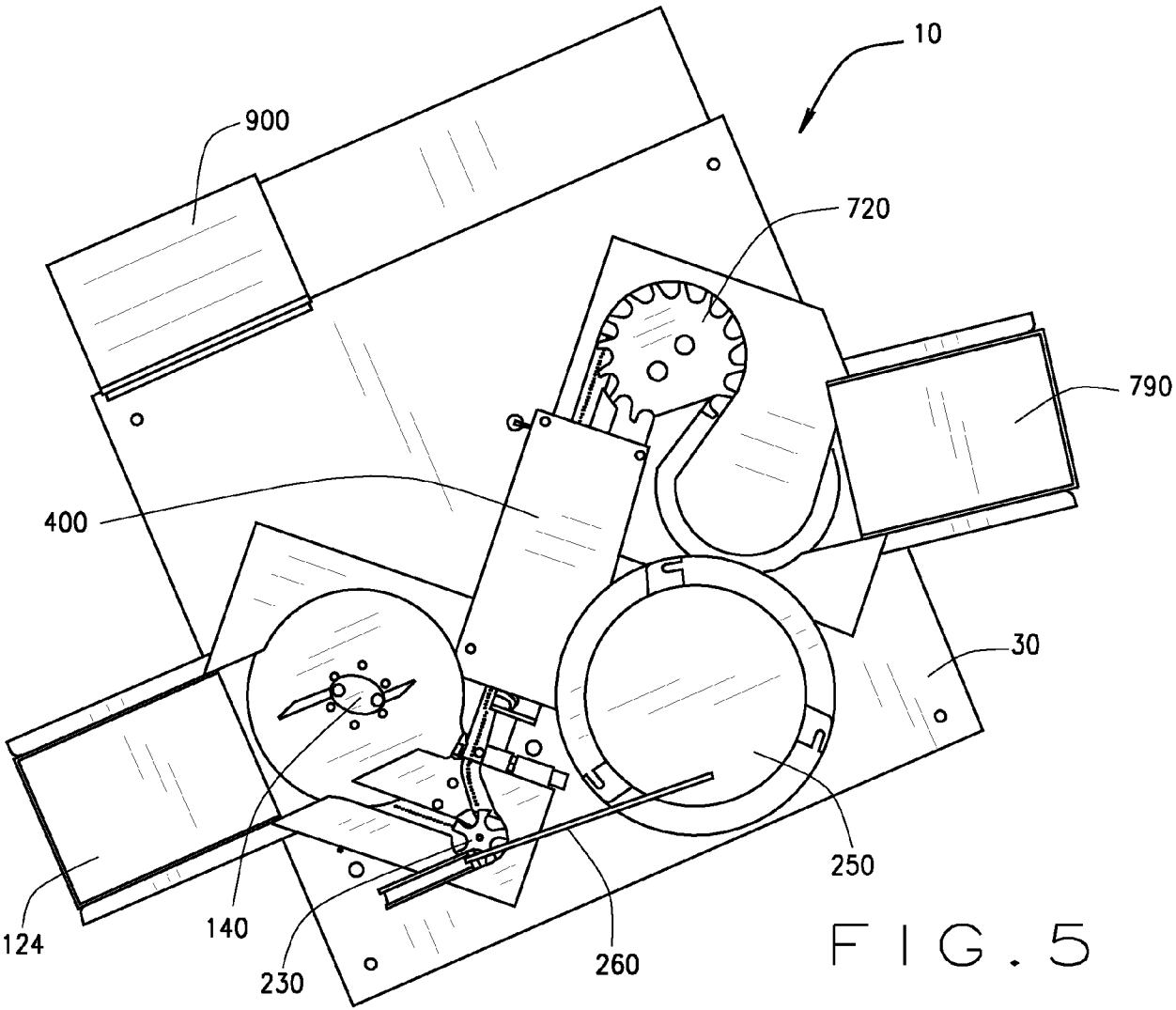
FIG. 5 shows a top-down view of the capping device.

A vial assembly 30 is shown in FIG. 2. The vial assembly 30 includes a vial 40 and a stopper 50 seated in a vial opening 48 of the vial 40. Before sealing the stopper 50 in the vial opening 48, medicine is placed in the vial. In some instances, industry demands an empty vial, and no medicine is placed in the vial 40.

The vial 40 defines a body and includes a vial neck 44 having a fluted shape, an exterior circumference 42, and a rim 46. The vial 40 is a non-metallic container. The capping device 10 positions a cap 60 over the stopper 50 and the vial opening 48 in a capping process. The cap 60 includes a metal portion 64 having a periphery 65 and in many cases a top portion 68. The metal portion 64 of the cap 60 is subjected to the magnetic forming of the capping device 10 in a sealing process to seal the cap 60 against the vial 40 and the stopper 50. In particular, the periphery 65 of the metal portion 64 is electromagnetically crimped to or under the rim 46. The metal portion 64 deforms during the crimping.

The capping device 10 generally includes: an infeed assembly 100 that feeds the vials 40 to the capping device 10; a capping assembly 200 that engages or caps the cap 60 on the vial 40; a rejection assembly 300 that checks the status of the placement of the cap 60 on the vial 40; an actuator assembly 400 that seals the cap 60 to the vial 40, using electromagnetic processes; and an outfeed assembly 700 that dispenses the sealed vials 40 from the actuator assembly 400.

The capping device 10 may be installed into a table 30. The table may include a hood 50 with a fan assembly 55. The fan 55 provides a unidirectional flow of air over the capping device 10 and the actuator assembly to maintain a classified particle count range. The hood 50 further assists in preventing contamination from entering the workings of the capping device 10. In other embodiments, the hood 50 and the fan 55 may be omitted if external conditions are maintained in an aseptic state, such as in a clean room.

Figure 6:
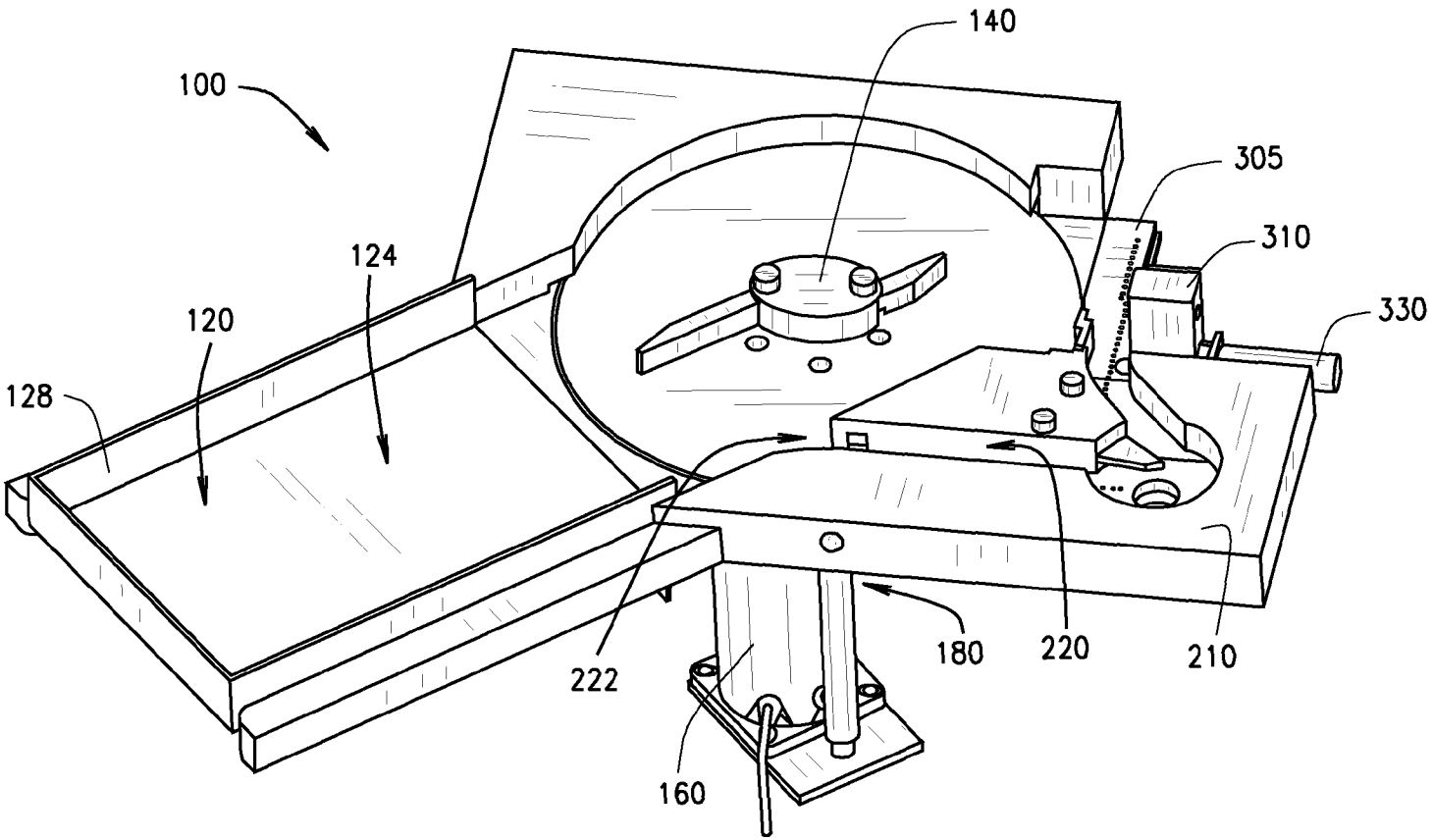
FIG. 6 shows a view of the infeed assembly.

The infeed assembly 100 will now be described in detail with reference to FIG. 6. An infeed tray 120 includes a support surface 124 that receives a supply of vials 40. At this point, the vials 40 will have already been filled with a medicine and closed with the stopper 50. One or more vials 40 are placed onto the infeed tray 120 at a single time. The infeed tray 120 provides a receptacle for the capping assembly 200. The infeed tray 120 may be filled to capacity with a group of the vials 40. Walls 128, extending from the support surface 124, help contain the vials 40 on the support surface 124.

An infeed turn disk 140 rotates to direct the vials 40 into the capping assembly 200. The infeed turn disk 140 is in operational connection with an infeed motor 160 and an infeed gear box 180. In this first embodiment, the operator fills the infeed tray 120 with the vials 40 to be capped. In other embodiments, a conveyor or other bulk handling method may be employed to provide the capping assembly 200 with the vials 40. The infeed tray 120 is preferably made of a stainless steel material that is suitable for an autoclaving process to maintain a sterile environment. The infeed turn disk 140 may be made of a delrin material, other plastic material or a stainless steel material. The infeed turn disk 140 rotates at approximately 1 rpm to approximately 50 rpm, with preferred rotational speeds of approximately 15 rpm to approximately 25 rpm, and approximately 20 rpm in particular.

Figure 7:
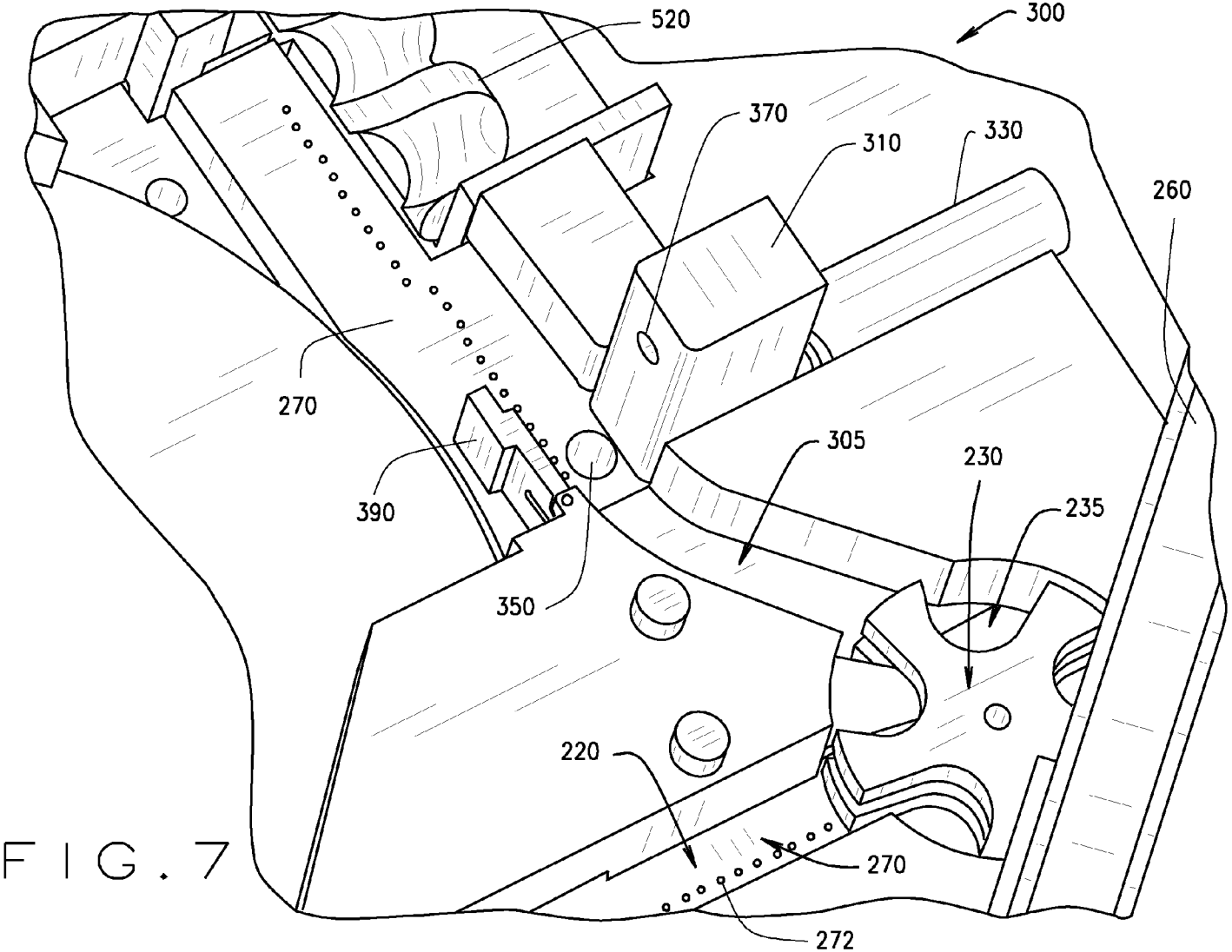
FIG. 7 shows a view of the rejection assembly.
Figure 8:
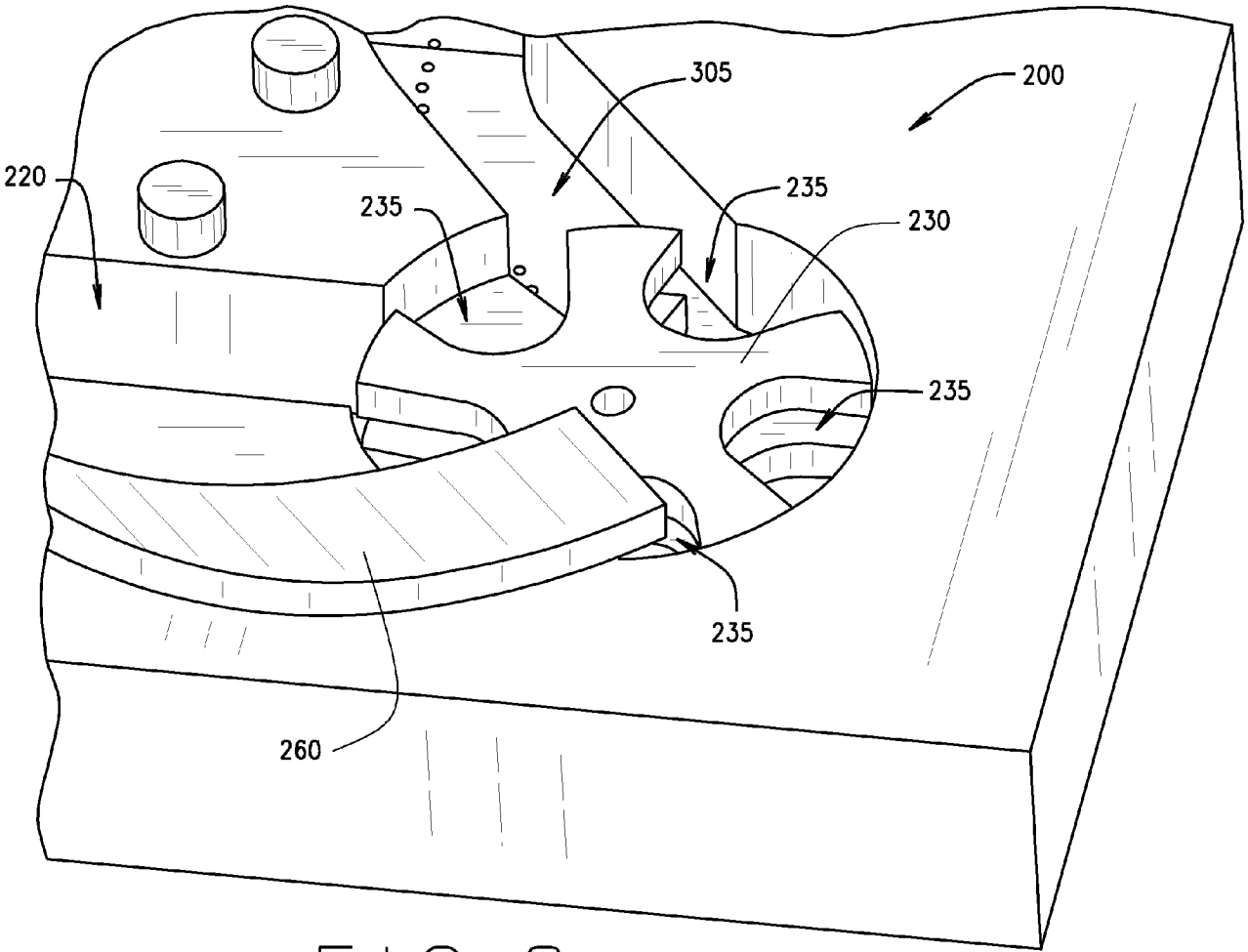
FIG. 8 shows the interaction of the cap track with the capping star wheel.
Figure 9:
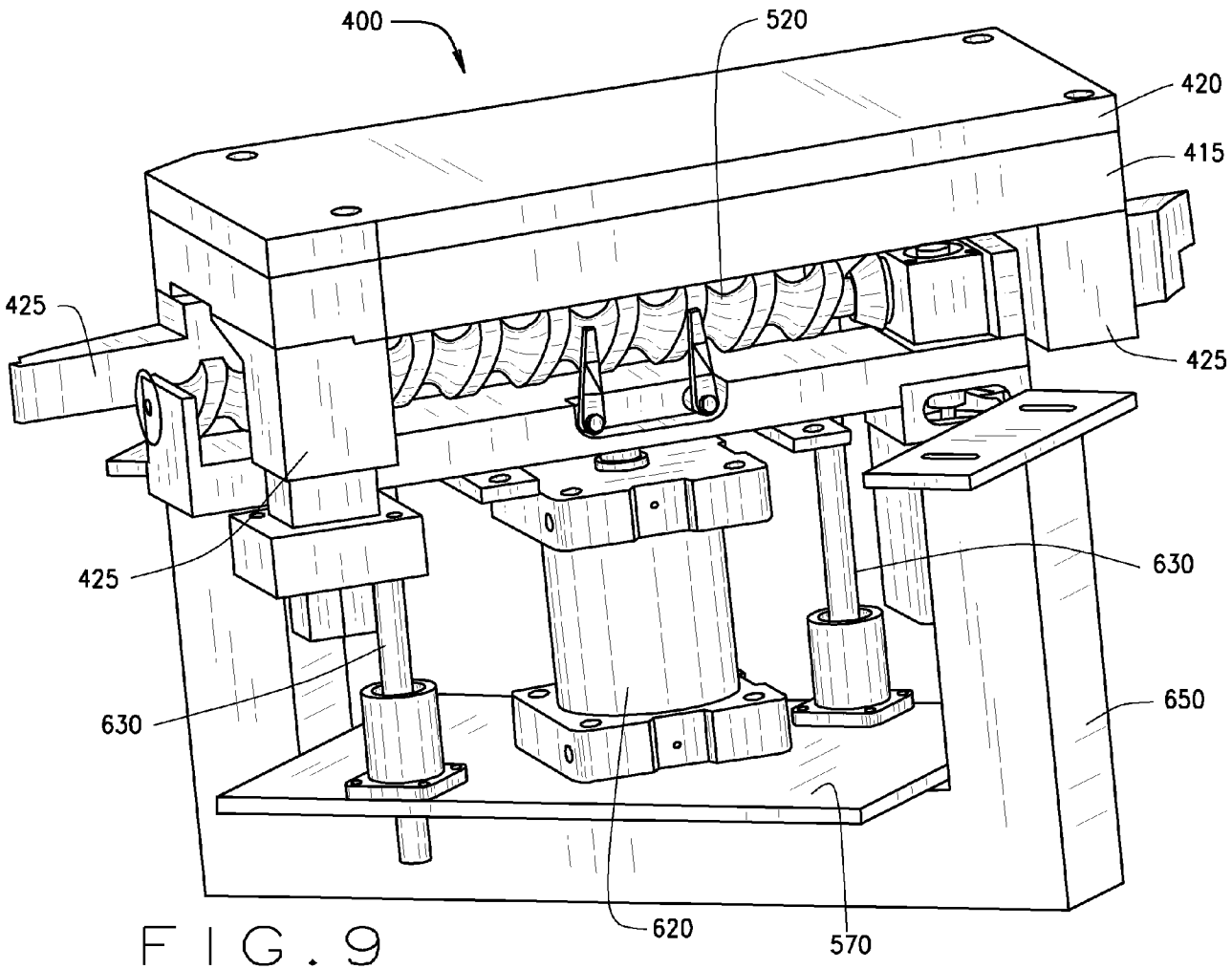
FIG. 9 shows a view of the actuator assembly.

The capping assembly 200 will now described with references to FIGS. 7 and 8. The capping assembly caps the vial 40 and the stopper 50 with the cap 60. The capping assembly 200 defines a cap path 220 that provides a passage from the infeed turn disk 140 to the capping star wheel 230. A cap path opening 222 opens to the cap path 220 and allows vials to enter the cap path 220 in a one-at-a-time manner.

A bottom surface of the cap path 220 includes an air conveyor 270 that provides lift to the vials to slide along the cap path 220. The air conveyor 270 includes air holes 272 that are approximately ¼ inch to approximately ½ inch apart. The air holes 272 may have a diameter of approximately 1/32 inch in diameter.

The capping star wheel 230 includes capping star wheel openings 235 that receive the vials 40. The capping star wheel 230 positions the vials 40 to receive the cap 60 from a cap track 260. The cap track 260 orientates the caps 60 for placement onto the vials 40 and stopper 50. The junction of the cap track 260 and the capping star wheel 230 allows for the cap 60 to be accurately positioned on top of the stopper 50, which is on top of the vial 40.

The cap track 260 receives caps 60 from a feeder bowl 250, which acts as a reservoir for the holding caps. The cap track 260 directs the caps 60 to the vials 40. The feeder bowl 250 includes a vibrating mechanism to eject the caps 60 onto the cap track 260. The vials 40 travel underneath the cap track 260 and the vials 40 pull the cap 60 off of the cap track 260.

The rejection assembly 300 will now be described with reference to FIG. 7. After the vial 40 and stopper 50 are capped with the cap 60, the capped vial 40 passes through the rejection assembly 300, which confirms the proper placement of the cap 60. The capping star wheel 230 feeds the vials 40 onto a sensor path 305 that directs the vials 40 past a vial sensor 350 and a metal sensor 370. The sensor path 305 also includes an air conveyor 270. The sensor path 305 provides a passage between the rejection assembly 300 and the actuator assembly 400. The vial sensor 350 checks for the vial 40 and the metal sensor 370 checks for the cap 60. Should a vial 40 not have a cap 60, a rejection block 310 actuates and ejects the vial 40 through a rejection gate 390. The rejection gate 390 is opened by the physical contact received from the rejection block 310. The rejected vial 40 is placed back into the infeed turn disk 140 for recapping at the capping assembly 200. The rejection block 310 is under the control of an air cylinder 330 that actuates the rejection block 310. The vial sensor 350, the metal sensor 370, and the air cylinder 330 are in electrical communication with the programmable logic controller 800. After passing through the vial sensor 350 and the metal sensor 370, the sensor path 305 connects to the actuator assembly 400.

The actuator assembly 400 will now be described with reference to FIGS. 9-13. The actuator assembly 400 receives the capped vials 40 from the capping assembly 200. The actuator assembly 400 generally includes an actuator 410, a loading assembly 500, and a lift assembly 600. The loading assembly 500 positions the capped vials 40 under the actuator 410. The lift assembly 600 raises such that the capped vials 40 are positioned in the actuator 410 for magnetic sealing of the cap 60 to the vial 40.

Figure 10:
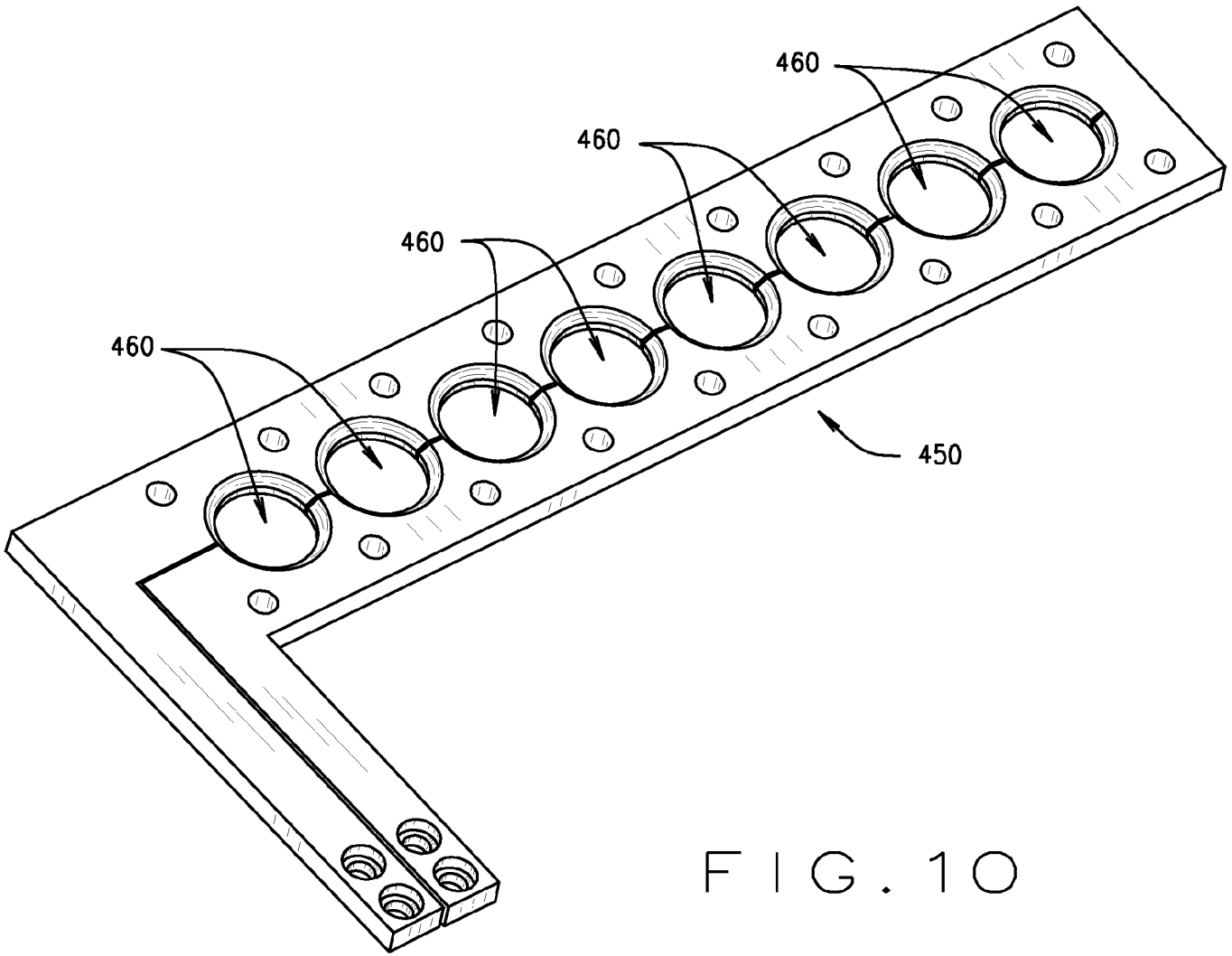
FIG. 10 shows a view of the actuator head.

The actuator 410 includes an actuator head 450 that emits the electromagnetic forces to seal the cap 60 to the vial 40. The actuator head 450 is preferably made of a copper alloy or other metal material suitable for electromagnetic forming. The actuator head 450 includes one or more actuator head openings 460, as shown in FIG. 10. In this embodiment, eight actuator head openings 460 are shown to simultaneously seal eight different vials 40. Other embodiments may include additional or fewer actuator head openings. During the sealing process, the vials with the metal caps 60 placed over the stopper 50 are raised into the actuator head openings 460 for electro-magnetic sealing. The actuator head openings 460 form recesses in the actuator head 450 that receive an upper portion of the vial 40.

Figure 11:
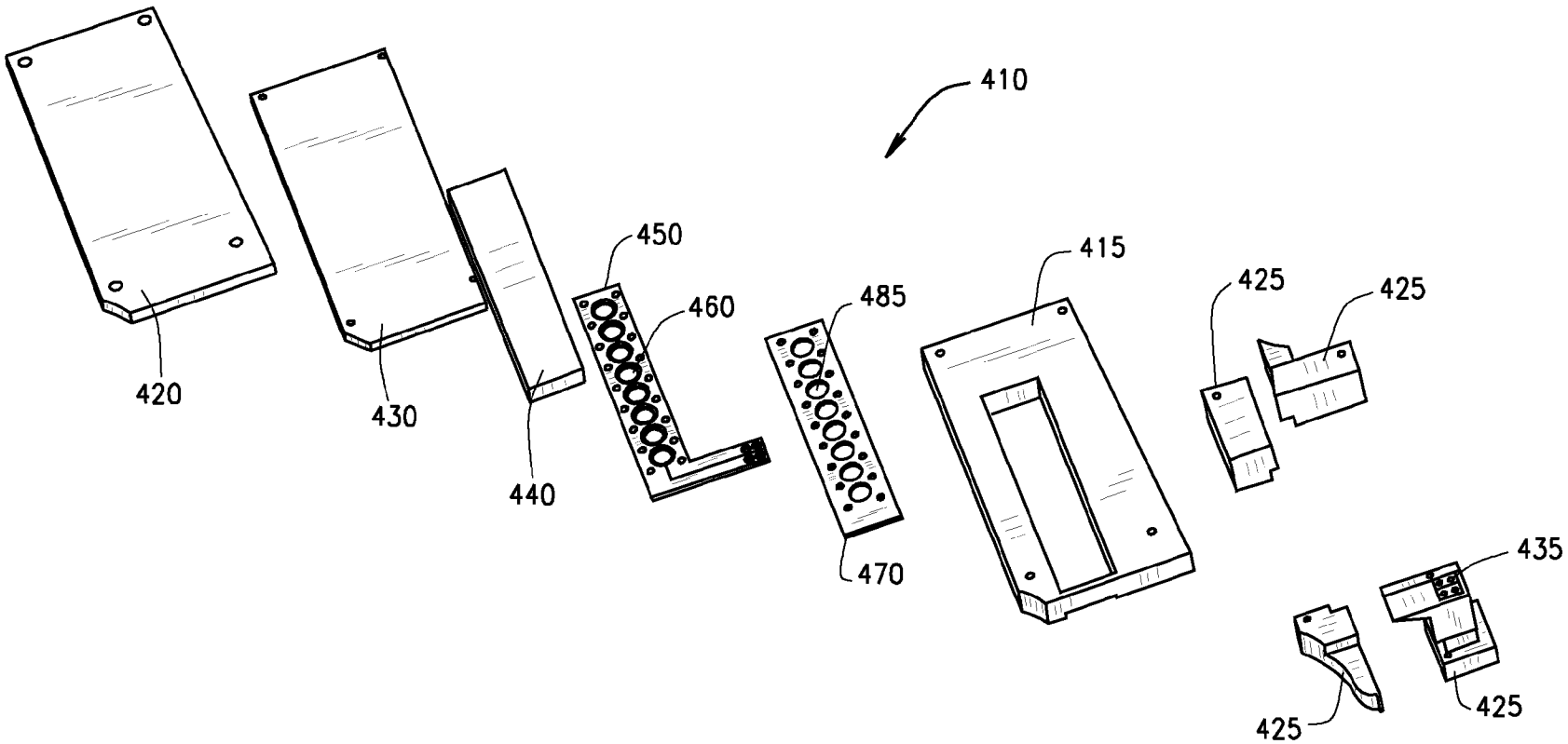
FIG. 11 shows an exploded view of the actuator.

With reference to FIG. 11, the actuator 410 further includes a cover 420 that forms the exterior portion of the actuator. The cover 420 is placed over a support member 430, which is preferably made from a rigid material such as stainless steel. The support member 430 is layered over a first insulation member 440, which covers the actuator head 450 and the actuator head openings 460. A second insulation member 470 includes the second insulation member 480 and the insulation member openings 485. An actuator base 415 supports the actuator 410. Actuator ends 425 include copper leads 435 in electrical communication with a power supply for providing the power for the electromagnetic forming.

Figure 13:
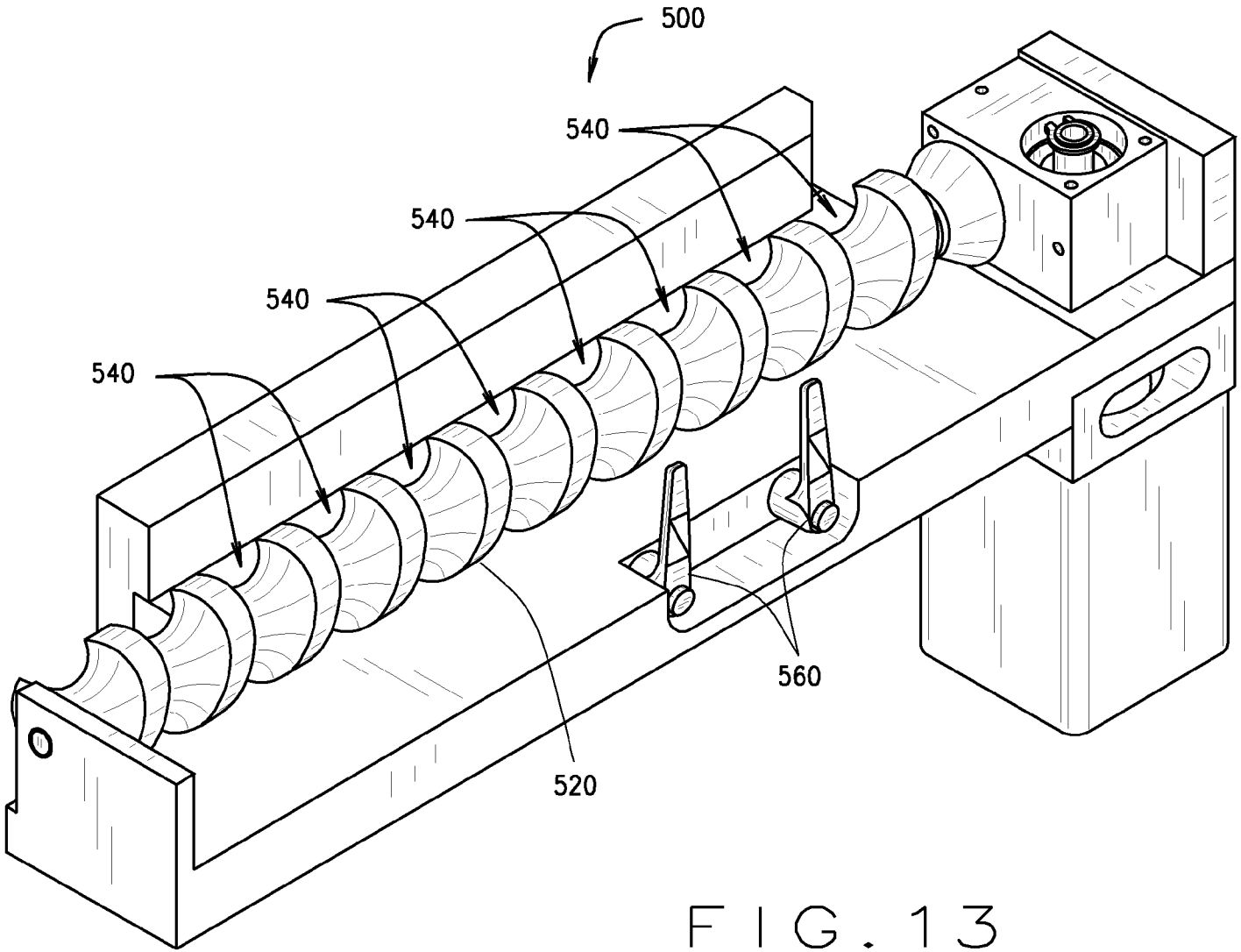
FIG. 13 shows a view of the loading assembly.

With reference to FIG. 13, the loading member 520 includes one or more stations 540 that receive and position the vials 40. The loading member 520 receives the vials 40 from the capping assembly 200 via the sensor path 305. Each station 540 corresponds to an insulation member opening 485 and an actuator head opening 460. The loading member 520 is in electrical communication and under control of the programmable logic controller 800.

Quick release pins 560 allow the loading assembly 500 to be removed from the capping device 10 and replaced with a different loading assembly 500 that is designed for a different number of vials 40 or different sized vials 40.

Figure 12:
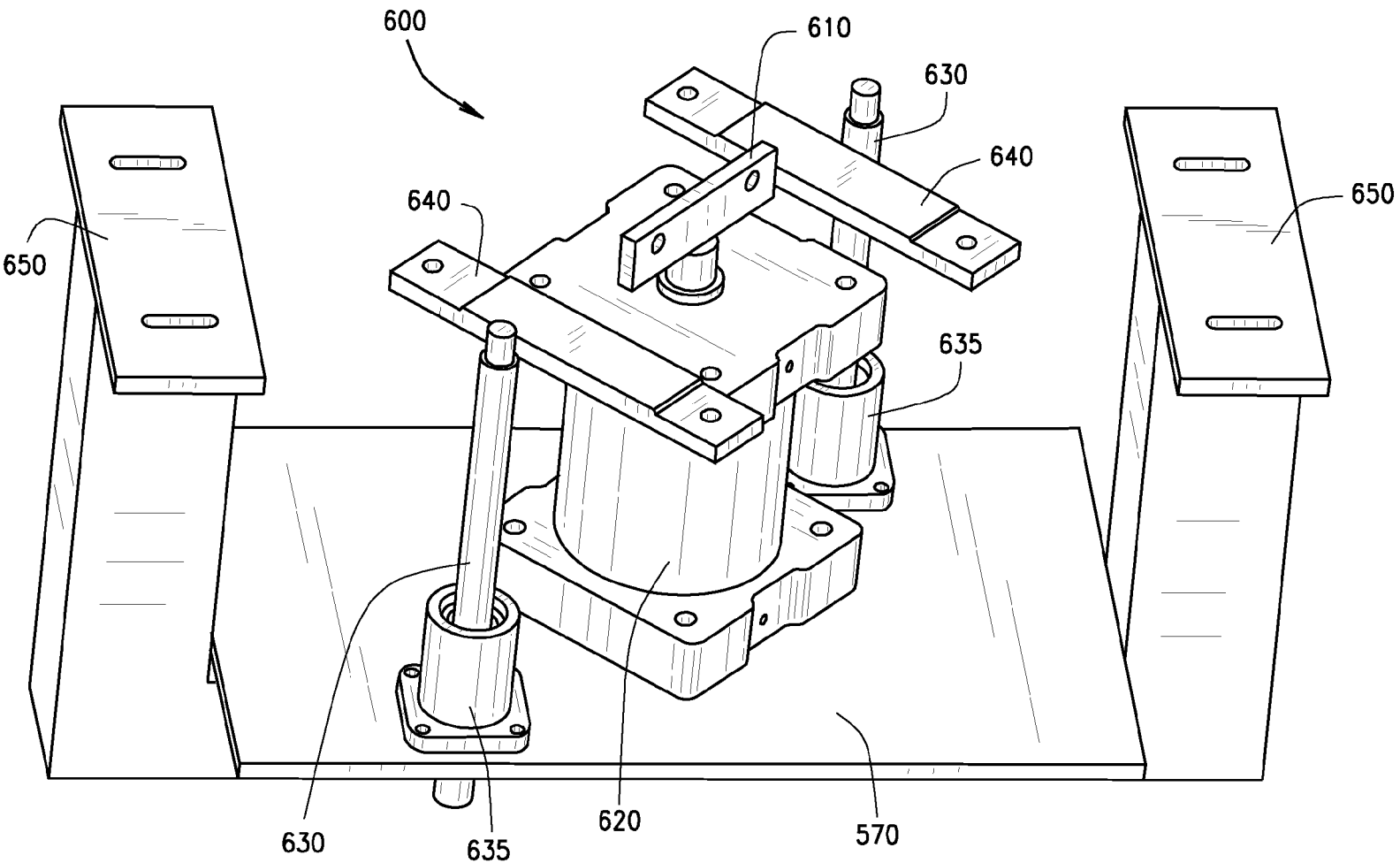
FIG. 12 shows a view of the lift assembly.

With reference to FIG. 12, the lift assembly 600 will now be described. A quick release flange 610 allows for a different loading assembly 500 to be placed onto the lift assembly 600 via the quick release pins 560. An air cylinder 620 raises and lowers the loading assembly 500. Pistons 630 along with bearings 635 screw into a base 570 of the lift assembly 600 for alignment of the loading assembly 500. Down supports 640 further stabilize the lift assembly 600 in the down movement. Lift assembly frame 650 secures to the table 30. The base 570 supports the air cylinder 620.

Figure 14:
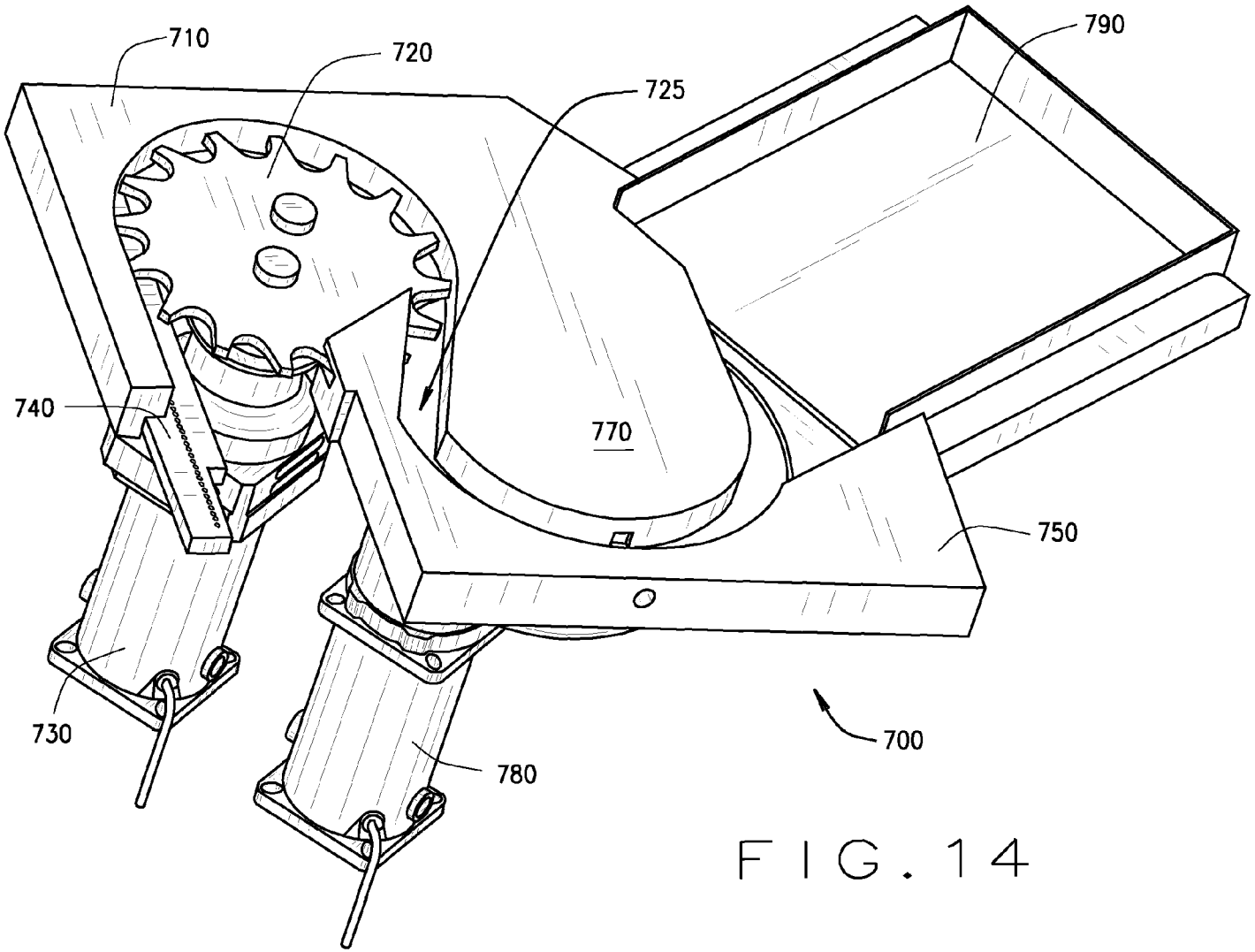
FIG. 14 shows a view of the outfeed assembly.

With reference to FIG. 14, the loading assembly 500 directs the now sealed vials 40 to the outfeed assembly 700. The outfeed assembly 700 includes an outfeed air conveyor 740 and an inspection guide block 710 that includes an inspection star wheel 720 rotatably mounted to the inspection guide block 710. An inspection star wheel motor 730 operates the inspection star wheel 720. The outfeed assembly 700 provides the operator with a visual review of the capped and sealed vials 40. From the inspection star wheel 720, the capped and sealed vials 40 are transferred via an inspection path 725 through an outfeed guide block 750. An outfeed turn disk 770 operated by an outfeed turn disk motor 780 feeds the capped and sealed vials 40 to an outfeed tray 790, where the capped and sealed vials may be removed for further processing. The outfeed tray 790 may be replaced with a conveyor or other material handling apparatus.

The exterior of the capping device 10 includes a touch screen HMI panel 900 to control the operation of the capping device 10. The HMI panel 900 includes start, stop, reset, and emergency stop buttons and is in electrical communication with the programmable logic controller 800. The HMI panel 900 further includes alarm and status indicator lights. The capping device 10 operates under the direction of the programmable logic controller 800. The capping device 10 operates on any voltage a customer may require. Typically, 208 single phase is sufficient.

A power pack, in the form of a capacitor bank 850 receives the incoming voltage and converts it to high pulsed energy. Upon command from the programmable logic controller 800, the capacitor bank 850 sends the pulsed energy to the actuator assembly 400 through a coaxial cable and then to the copper leads 435 of the actuator ends 425. The copper leads 435 are in electrical communication with the actuator head 450. The pulsed energy is emitted by the actuator head 450 and results in the creation of a magnetic field around the capped vials 40. The actuator head 450 emits the magnetic feed in a particular shape, causing the metal portion 64 of the cap 60 to bend and seal to the vial 40.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

What is claimed is:

1. A method for sealing a plurality of non-metallic containers using high velocity electromagnetic metal forming, comprising:

inserting a stopper into an opening of each of a plurality of non-metallic containers;

engaging the plurality of the non-metallic containers with caps, wherein the caps are positioned over the stoppers, and wherein each cap having a metal portion, applying electromagnetic forces to the metal portion of each cap engaged to the plurality of the non-metallic containers, and sealing the caps engaged to the plurality of the non-metallic containers by simultaneously crimping the caps to the non-metallic containers by application of the electromagnetic forces.

2. The method according to claim 1, further comprising:

directing the plurality of non-metallic containers to an actuator; and applying electromagnetic forces from the actuator to the metal portion of each cap.

3. The method according to claim 2, further comprising removing the sealed plurality of non-metallic containers from the actuator and directing a second plurality of non-metallic containers to the actuator.

4. The method according to claim 2, further comprising positioning the plurality of non-metallic containers in the actuator.

5. The method according to claim 2, further comprising positioning the plurality of non-metallic containers in openings defined by the actuator.

6. The method according to claim 2, further comprising providing a unidirectional flow of air over the actuator.

7. The method according to claim 2, further comprising raising the plurality of non-metallic containers into openings defined by the actuator.

8. The method according to claim 1, wherein the non-metallic container is a vial.

9. The method according to claim 1, further comprising providing the plurality of non-metallic containers onto an infeed tray; checking the plurality of non-metallic containers for engagement of the cap; and returning a non-metallic container of the plurality of non-metallic containers for engagement with the cap if no cap is engaged.

10. The method according to claim 1, further comprising simultaneously sealing the plurality of non-metallic containers, wherein the plurality of non-metallic containers comprise 2 to 20 non-metallic containers.

11. A method for sealing a plurality of non-metallic containers using high velocity electromagnetic metal forming, comprising:

inserting a stopper into an opening of each of a plurality of non-metallic containers;

engaging a cap over the stopper and the opening of each of the plurality of non-metallic containers; wherein each cap has a metal portion, wherein each of the plurality of non-metallic containers defines a body having a neck that communicates with the opening; wherein the metal portion of the cap defines a periphery, the periphery of the metal portion being adapted to seal to or under a rim defined by the neck when applying the electromagnetic forces to the metal portion of each cap;

applying electromagnetic forces to the metal portion of each cap engaged to the plurality of the non-metallic containers; and, sealing the caps engaged to the plurality of the non-metallic containers by simultaneously crimping the caps to the non-metallic containers by application of the electromagnetic forces.

12. A method for sealing a plurality of non-metallic containers using high velocity electromagnetic metal forming, comprising:

engaging the plurality of the non-metallic containers with caps, each cap having a metal portion, applying electromagnetic forces to the metal portion of each cap engaged to the plurality of the non-metallic containers, sealing the caps engaged to the plurality of the non-metallic containers by simultaneously crimping the caps to the non-metallic containers by application of the electromagnetic forces; and, checking the plurality of non-metallic containers for engagement of the cap.

13. A method for sealing caps and stoppers on non-metallic containers using high velocity electromagnetic metal forming, comprising:

feeding a plurality of the non-metallic containers to a capping assembly, wherein the plurality of non-metallic containers each comprise a stopper positioned in an opening of the non-metallic containers, engaging a cap onto each of the non-metallic containers in the capping assembly, feeding the non-metallic containers to an actuator assembly, and applying electromagnetic forces from the actuator assembly to simultaneously seal the cap over the stopper and onto each of the non-metallic containers.

14. The method according to claim 13, wherein the engaging the cap onto each of the plurality of non-metallic containers requires engaging the cap onto the opening defined by each of the non-metallic containers.

15. The method according to claim 13, wherein the applying the electromagnetic forces from the actuator assembly to seal the cap onto each of the non-metallic containers requires deforming a metal portion defined by each cap engaged to the non-metallic containers.

16. A capping device for sealing caps on non-metallic containers using high velocity electromagnetic forming, comprising:

an infeed assembly comprising a receptacle to receive a plurality of the non-metallic containers, wherein the plurality of non-metallic containers comprise a stopper positioned in an opening of the non-metallic containers, the plurality of non-metallic containers define a body having a neck that communicates with the opening; the infeed assembly further comprising a first passage;

a capping assembly connected to the first passage of the infeed assembly, the capping assembly comprising a second passage and connecting to a supply of caps for engaging the caps to the plurality of non-metallic containers;

an actuator assembly connected to the second passage of the capping assembly, the actuator assembly configured to emit electromagnetic forces for simultaneously sealing the caps against the stoppers and to or under the necks of the plurality of non-metallic containers; and an outfeed assembly that dispenses the plurality of non-metallic containers from the actuator assembly.

17. The capping apparatus according to claim 16, wherein the actuator assembly includes a plurality of positions for the non-metallic containers.

18. The capping device according to claim 16, wherein the actuator assembly comprises an actuator that emits the electromagnetic forces to seal the caps to the non-metallic containers; and wherein the actuator comprises a plurality of actuator openings that receive an upper portion of each of the non-metallic containers.

19. A capping device for sealing caps on non-metallic containers using high velocity electromagnetic forming, comprising:

an infeed assembly comprising a receptacle to receive a plurality of the non-metallic containers; the infeed assembly further comprising a first passage;

a capping assembly connected to the first passage of the infeed assembly, the capping assembly comprising a second passage and connecting to a supply of caps for engaging the caps to the plurality of non-metallic containers;

an actuator assembly connected to the second passage of the capping assembly, the actuator assembly configured to emit electromagnetic forces for simultaneously sealing the caps to the plurality of non-metallic containers;

an outfeed assembly that dispenses the plurality of non-metallic containers from the actuator assembly; and, a rejection assembly that checks the status of the engagement of the caps to the non-metallic containers.

* * * * *